US007410270B2

(12) United States Patent
Long et al.

(10) Patent No.: US 7,410,270 B2
(45) Date of Patent: Aug. 12, 2008

(54) PORTABLE BAG WITH LIGHTING SYSTEM

(75) Inventors: Jon Darin Long, Ogden, UT (US); David M. Grand Pre, Ogden, UT (US)

(73) Assignee: RSGA, Inc., Ogden, UT (US)

( * ) Notice: Subject to any disclaimer, the term of this patent is extended or adjusted under 35 U.S.C. 154(b) by 0 days.

(21) Appl. No.: 11/675,457

(22) Filed: Feb. 15, 2007

(65) Prior Publication Data

US 2008/0037242 A1 Feb. 14, 2008

(51) Int. Cl.
*A45C 15/06* (2006.01)

(52) U.S. Cl. ..... 362/156; 362/108

(58) Field of Classification Search ..... 362/84, 362/85, 103, 106, 108, 154–156, 183–186, 362/190, 194, 200, 202, 205, 208, 276, 394, 362/240, 244, 245, 249, 251, 800, 802, 806–808; 40/541, 566, 567, 580
See application file for complete search history.

(56) References Cited

U.S. PATENT DOCUMENTS 3,239,658 A * 3/1966 Castaldo ..... 362/155
4,638,412 A * 1/1987 Weigert ..... 362/156
4,720,764 A * 1/1988 Lucas ..... 361/212
4,755,802 A * 7/1988 Urbanczyk ..... 340/571
4,972,304 A 11/1990 Ylla
5,424,926 A * 6/1995 Myers ..... 362/156
5,597,230 A * 1/1997 Newman ..... 362/154
5,836,671 A 11/1998 Chien
5,961,017 A 10/1999 Mehler
6,099,140 A * 8/2000 Norris ..... 362/156
6,121,877 A * 9/2000 Johnson et al. ..... 340/571
6,267,485 B1 * 7/2001 Rodgers ..... 362/156
6,273,582 B1 * 8/2001 Taggart et al. ..... 362/119
6,281,800 B1 8/2001 Sizemore
6,380,856 B1 * 4/2002 Johnson et al. ..... 340/571
6,443,590 B1 9/2002 Lovitt
6,499,857 B1 * 12/2002 Lumley ..... 362/154
6,502,951 B2 1/2003 Marshall
6,508,568 B1 * 1/2003 Blue-Recio ..... 362/156
6,582,093 B1 6/2003 Branaugh et al.
6,975,221 B2 * 12/2005 Monck ..... 340/539.11
7,055,978 B2 6/2006 Worthington

FOREIGN PATENT DOCUMENTS

EP 1892734 A1 * 2/2008

* cited by examiner

*Primary Examiner*—Hargobind S Sawhney
(74) *Attorney, Agent, or Firm*—Fish & Richardson P.C.

(57) ABSTRACT

A portable bag including a bag body and a lighting system secured to the bag body. The lighting system includes a lighting system body, at least one light emitter carried by the lighting system body, a power source supplying power to at least one light emitter, and a control circuit controlling at least one light emitter. A remote controller is in wireless communication with the control circuit to control at least one light emitter. Another portable bag includes a bag body, at least one lighting cartridge having a cartridge body and at least one light emitter carried by the cartridge body, a power source supplying power to at least one light emitter, and at least one lighting base secured to the bag body. The lighting base is configured to receive and removably secure the lighting cartridge.

18 Claims, 8 Drawing Sheets

PORTABLE BAG WITH LIGHTING SYSTEM

TECHNICAL FIELD

This disclosure relates to portable bags and lighting systems.

BACKGROUND

Portable bags allow a user to carry multiple items. Some bags, such as backpacks, are specifically designed to carry certain items. Common examples include backpacks for small, high-value items such as laptop computers and cameras. The larger the bag, the more difficult it becomes to view a bottom region inside the bag.

SUMMARY

In one aspect, a portable bag includes a bag body and a lighting system secured to the bag body. The lighting system includes a lighting system body, at least one light emitter carried by the lighting system body, a power source supplying power to at least one light emitter, and a control circuit controlling at least one light emitter. A remote controller is in wireless communication with the control circuit to control at least one light emitter. The lighting system illuminates an interior and/or an external of the bag body.

Implementations of this aspect of the disclosure may include one or more of the following features. In some implementations, the bag body is a backpack, soft storage container, or a handbag (e.g. a purse, satchel, or duffle bag). In some examples, the lighting system is embedded in the bag body and configured to illuminate the interior of the bag body. In some instances, the lighting system is configured to illuminate an area exterior of the bag body. The remote controller may be at least partially embedded in the bag body.

The lighting system may also include a reflective surface carried by the lighting system body and configured to enhance light from at least one light emitter. A lens is carried by the lighting system body, in some examples, and configured to enhance light from at least one light emitter. The lens is adjustable to defuse and focus light from at least one light emitter.

The lighting system body includes a main housing and a base. The base is secured to the bag body and is configured to receive the main housing. The main housing is removably secured to the base. The base defines a receptacle configured to receive the main housing. The base may be embedded in the bag body. In some instances, the base is configured to house the power source. The main housing is configured to house at least one light emitter.

In another aspect, a portable bag includes a bag body, at least one lighting cartridge having a cartridge body and at least one light emitter carried by the cartridge body, a power source supplying power to at least one light emitter, and at least one lighting base secured to the bag body. The lighting base is configured to receive and removably secure the lighting cartridge. When the portable bag includes multiple lighting cartridges and/or lighting bases, different lighting cartridges may be interchanged with different lighting bases in various locations (e.g. to interchange lighting cartridges having different colored light emitters).

Implementations of this aspect of the disclosure may include one or more of the following features. The bag body may be a backpack or a handbag. The lighting cartridge, in some instances, includes a power connector disposed on an outer surface of the cartridge body. The power connector is configured to mate with a corresponding lighting base power connector within a receptacle defined by lighting base as the lighting cartridge is placed within the receptacle to establish an electric power connection to the lighting cartridge. In other instances, the lighting cartridge power connector is configured to mate with a corresponding power source power connector. In one example, at least one light emitter is activated by moving the light cartridge relative to the lighting base.

In some implementations, the portable bag includes a control circuit that controls at least one light emitter. The portable bag may also include a remote controller in wireless communication with the control circuit to control at least one light emitter. The remote controller is at least partially embedded in the bag body, in some examples.

In some examples, the lighting cartridge includes a reflective surface and a lens, both carried by the cartridge body and configured to enhance light from at least one light emitter. The lens is adjustable to defuse and focus light from at least one light emitter.

In some implementations, the base includes at least one magnet to retain the lighting cartridge, which has a magnetically attractable surface configured to mate with the at least one magnet. In some examples, at least one magnet delivers power to the lighting cartridge.

In other implementations, the lighting cartridge is secured to the base by hook and loop fasteners. In some examples, power is delivered to the lighting cartridge through the hook and loop fasteners.

The lighting cartridge may be configured to articulate, thereby providing a wide sweepable lighting range. In some implementations, the lighting cartridge includes a cartridge body base and a bezel housing rotatably and telescopically secured to the cartridge body base. The bezel housing carries at least one light emitter. In some examples, the bezel housing is configured to move along three axes of motion. The bezel housing may also be configured as a switch. In some instances, the bezel housing includes a lens configured to focus light emitted by at least one light emitter.

The power source in each aspect may include a battery, rechargeable battery, at least one solar energy cell and/or a hand powered generator. In some instances, the base is configured to house the power source. In other instances, the main housing is configured to house the power source. In yet more instances, the power source is carried by the bag body separate from the base and the main housing.

In each aspect, the portable bag may include an audible device carried by the bag body. In some instances, the audible device is carried by the main housing or lighting cartridge body. The audible device may include a programmable alarm clock. The audible device is programmable with auditory content, in some examples, providing custom audio playback. In some instances, the audible device is in communication with the control circuit and controllable with the remote controller. In other instances, the audible device is in wireless communication with the remote controller.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
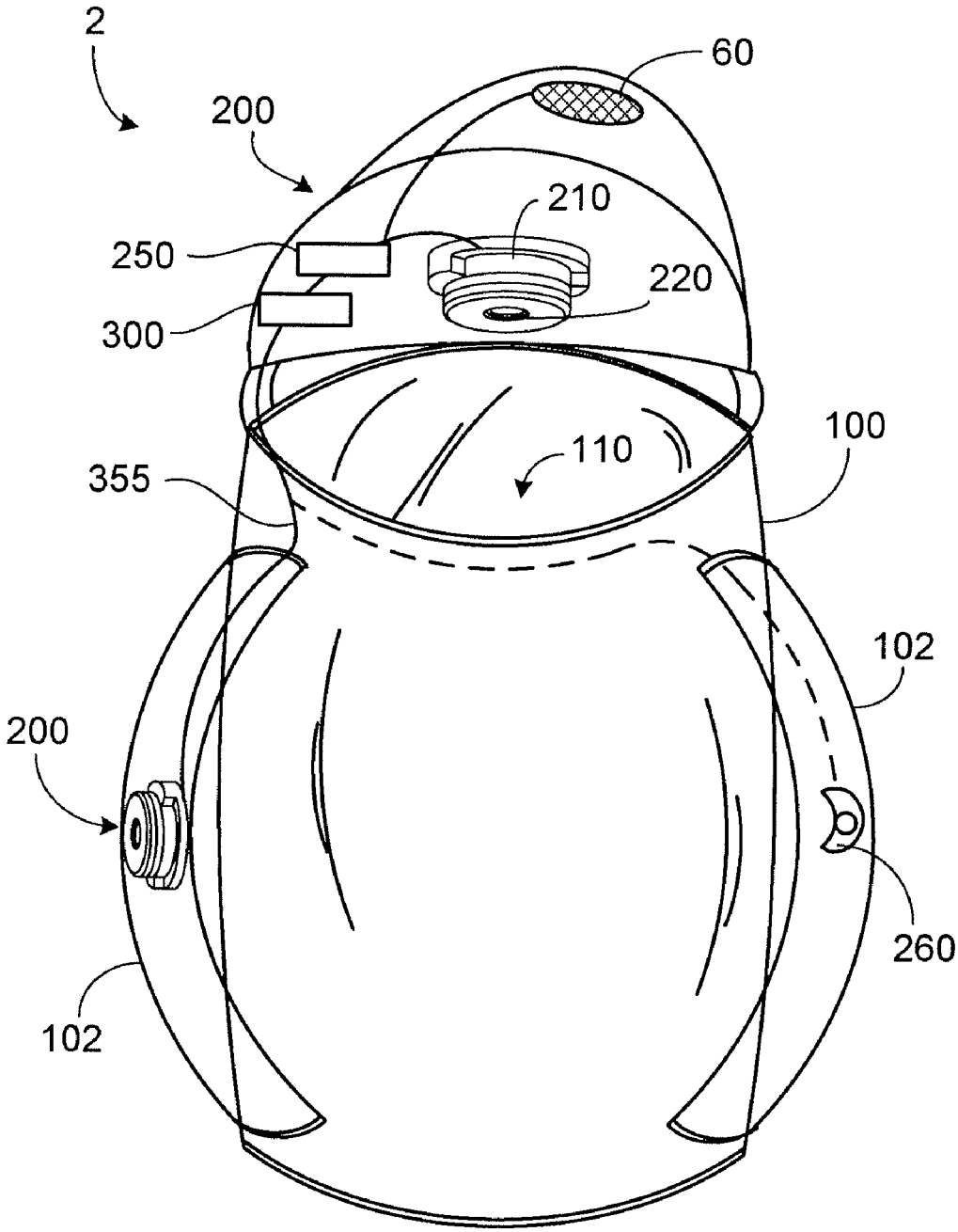
FIG. 1 is a perspective view of a portable bag incorporating a lighting system.

Referring to FIG. 1, a portable bag 2 includes a bag body 100 and at least one lighting system 200 secured to the bag body 100 (e.g. an interior 110 of the bag body 100). The lighting system 200 may be secured to the bag body 100 by sewing, a strap 102, hook and loop fasteners, adhesives, and magnets. The lighting system 200 includes a lighting system body 210, at least one light emitter 220 (e.g. a light emitting diode (LED)) carried by the lighting system body 210, a power source 300 supplying power to at least one light emitter 220, and a control circuit 250 controlling at least one light emitter 220. The control circuit 250 may be carried by the lighting system body 210 or the bag body 100 (e.g. embedded in a lining). In some implementations, the bag body 100 is a backpack, as illustrated in FIG. 1. The bag body 100 may be any other type of bag as well (e.g. soft storage container, a purse, satchel, or duffle bag). The lighting system 200 is embedded or integrated in the bag body 100 and configured, in some examples, to illuminate the interior 110 of the bag body 100. In additional examples, the lighting system 200 is configured to illuminate an area exterior of the bag body 100. The light emitted by the lighting system 200 may be red, white or any other color. Examples of light emitters 220 include light emitting diodes, illuminable gels, and electroluminescent wire. In some examples, the light emitters 220 include optical fibers. This lighting system 200 can be installed in the bag body 100 either at the time of manufacture or as an after market system.

The lighting system 200 is controllable at the light system body (e.g. via a switch, dial, or motion detector) and/or by a remote controller 260. The remote controller 260 can be located anywhere around or in the bag body 100 including on a strap 102 (as shown) or hanging from tether. The remote controller 260 is in wireless communication with the control circuit 250 (e.g. infrared or radio frequency) to control at least one light emitter 220. For example, when the portable bag 2 includes multiple lighting systems 200, the remote controller 260 may control each light emitter 220 of each lighting systems 200. Each lighting systems 200 may include a switch to control each light emitter 220 or over-ride the remote controller 260. In some instances, the remote controller 260 is at least partially embedded in the bag body 100 for aesthetics or robust attachment.

In some implementations, the remote controller 260 is a switch in communication with and controlling at least one light emitter 220. The remote controller 260 may be secured to a part of the bag body 100, including a strap 102 secured to the bag body 100.

The control circuit 250 and wiring 355 may be woven into fabric of the bag body 100, or held in place within a seam or by a releasable fastener. In some instances, the lighting system 200 is mounted on a surface of the bag body 100 using adhesives, snaps, hook and loop fasteners, magnets, or any other type of mounting device known. The remote controller 260 may be incorporated into the portable bag 2 using the same techniques as described for the control circuit 250 and wiring 355.

Figure 2:
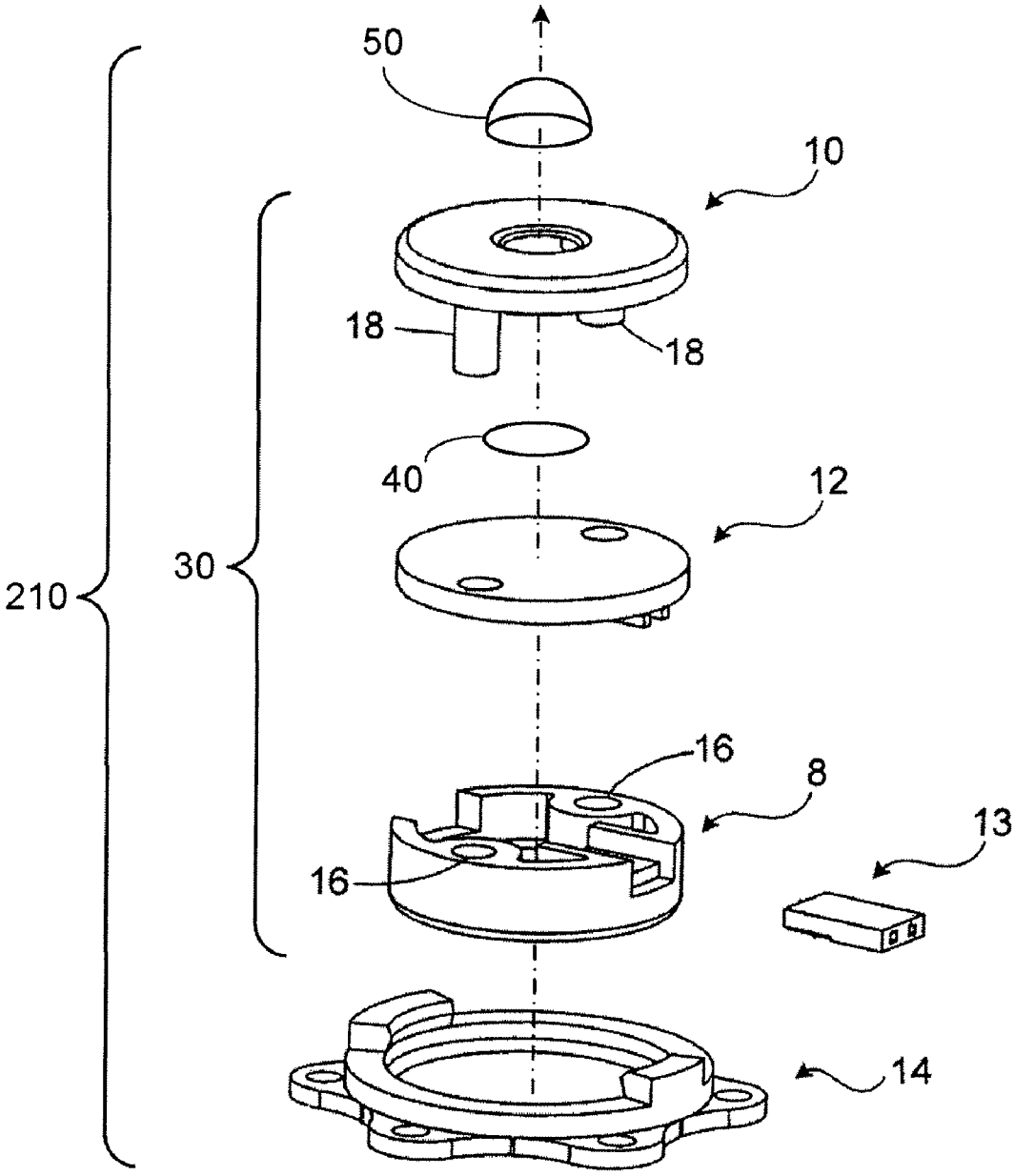
FIG. 2 is an exploded view of a lighting system.

Referring to FIG. 2, in some examples lighting system body 210 includes a main housing 30 (also referred to as a cartridge) and a base 14. The main housing 30 is removably secured to the base 14, which in some instances, defines a receptacle 15 configured to receive the main housing 30. The base 14 is secured to the bag body 100. The main housing 30 is configured to house at least one light emitter 220. In some instances, the base 14 is configured to house the power source 300. In other instances, the main housing 30 is configured to house the power source 300. In yet more instances, the power source 300 is carried by the bag body 100 separate from the base 14 and the main housing 30.

In the example shown in FIG. 2, the lighting system body 210 includes of a back housing 8, a front housing 10 secured to the back housing 8 to form a main housing 30. The lighting system body 210 also includes a heat sink 12 secured between back and front housings 8 and 10, respectively, a power connector 13 received by the main housing 30, and a base 14 configured to receive the back housing 8. In some implementations, the lighting system body 210 is manufactured as one entire unit. In other implementations, the front housing 10 is removable, allowing easy servicing of the light emitters 220, for example, as when an LED 220 burns out or to replace an LED 220 with a different color light or wattage.

Figure 3:
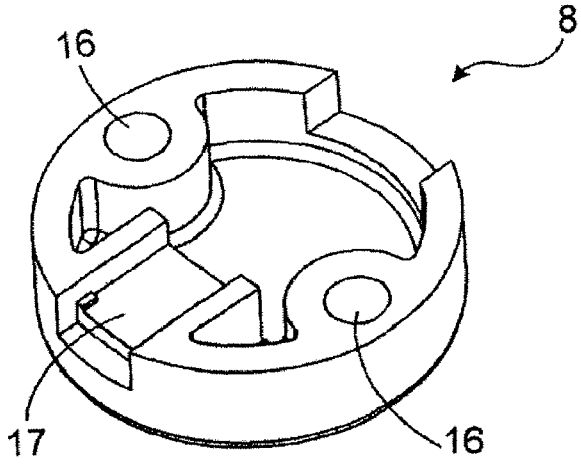
FIG. 3 is a perspective view of a back housing.
Figure 4:
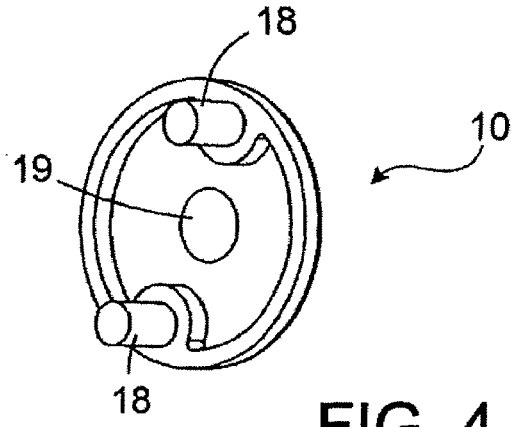
FIG. 4 is a perspective view of a front housing.
Figure 5:
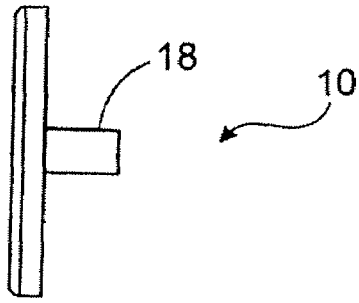
FIG. 5 is a side view of a front housing.

Referring to FIGS. 3-5, the back housing 8 defines two openings 16 configured to receive to two tabs 18 extending from the front housing 10. A slot 17 defined in the back housing 8 is configured to receive the power connector 13, which delivers power to at least one light emitter 220. The front housing 10 incorporates at least one opening 19 for at least one light emitter 220 housed by the main housing 30.

Figure 6:
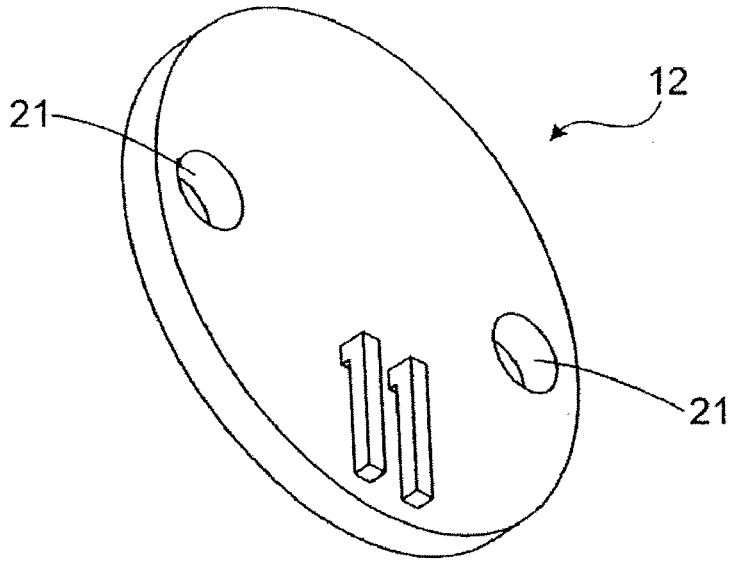
FIG. 6 is a perspective view of a heat sink.

Referring to FIG. 6, to prevent heat damage, a heat sink 12 may be incorporated in the lightly system body 210 and secured between the back housing 8 and the front housing 10. The heat sink 12 provides heat dissipation for the light emitter 220. The heat sink 12 defines two openings 21 configured to receive the tabs 18 of the front housing 10. In some instances, a metal lighting system body 210 may be used to dissipate heat. In other instances, the lightly system body 210 may be made of plastic or rubber (e.g. silicon).

Figure 7:
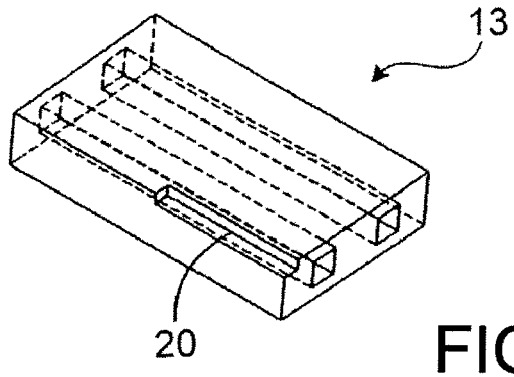
FIG. 7 is a perspective view of a power connector.

FIG. 7 illustrates an example of the power connector 13. As shown, the power connector 13 is a bipolar plug. The power connector 13 may be unidirectional to guide orientation of the connector 13 during insertion into the back housing 8. The power connector 13 shown uses an indentation 20 to ensure that it is not inserted incorrectly.

Figure 8:
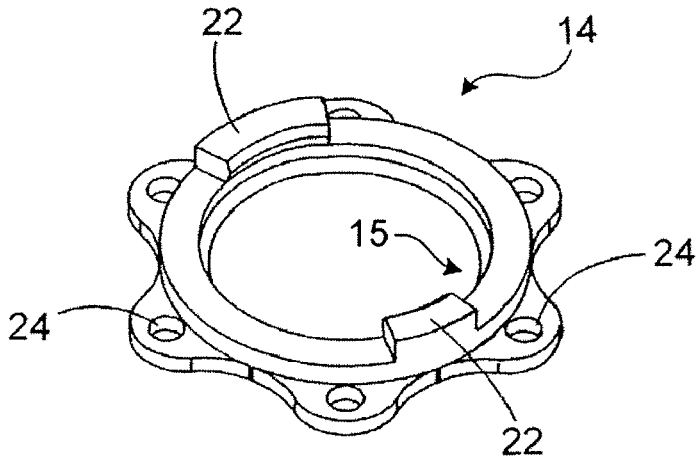
FIG. 8 is a perspective view of a base.

FIG. 8 is a perspective view of the base 14. The base 14 is configured to receive the back housing 8 which is removably secured. In the example shown, the back housing 8 is retained against the base 14 by snapping the back housing 8 into a pair of retaining tabs 22 configured to receive the back housing 8. In some instances, the base 14 defines one or more openings 24 which can be used to fasten the base 14 to a surface of the bag body 100. In some examples, the base 14 is fastened to a surface of the bag body 100 using an adhesive, hook and loop fasteners, or other mechanical fasteners.

Figure 9:
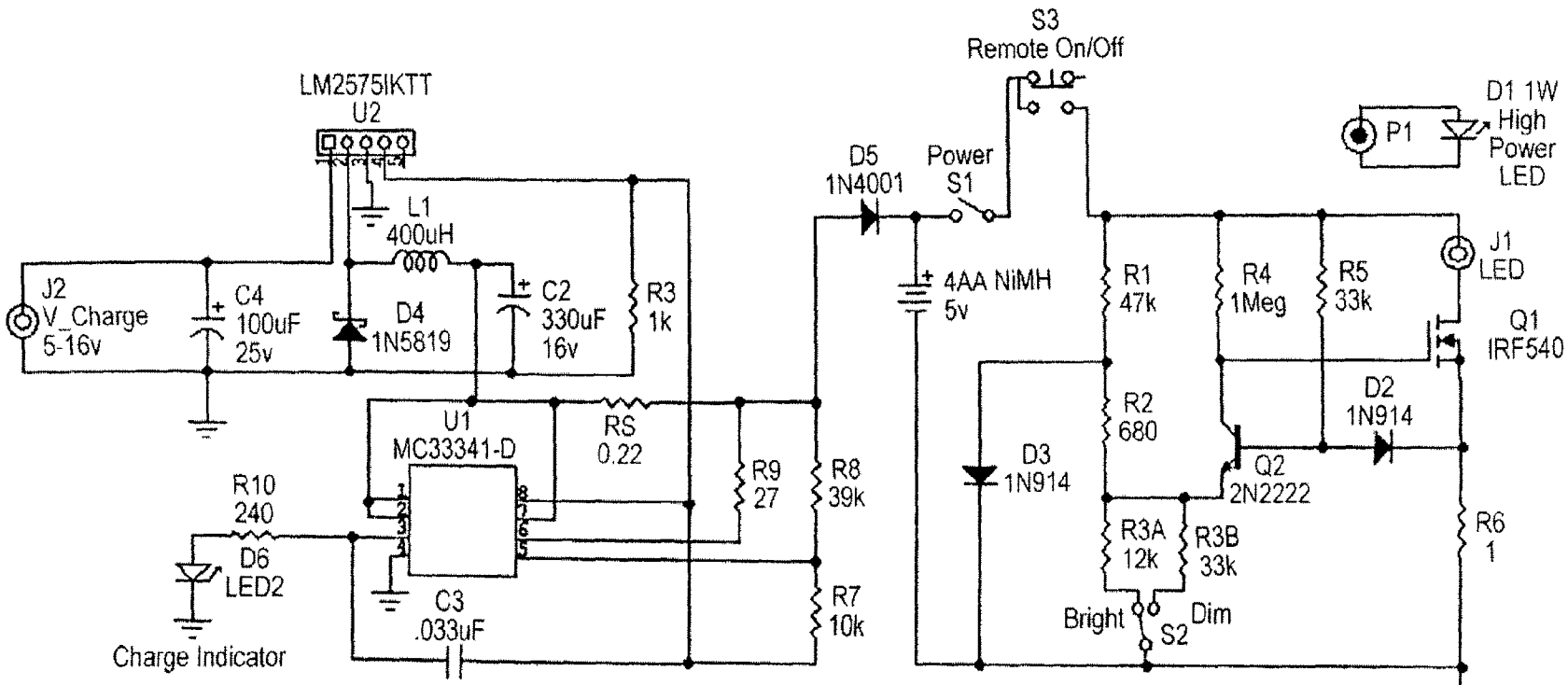
FIG. 9 is a schematic view of a control circuit used to control a lighting system.

FIG. 9 illustrates an example of the control circuit 250 used to control the lighting system 200. In some examples, the control circuit 250 incorporates a three way switch that can be controlled at two different locations such as at an opening of the bag body 100 and proximate to the lightly system body 210. In examples using a remote controller 260, the remote controller 260 is either wired to the control circuit 250 or in wire communication with the control circuit 250 to control at least one light emitter 220.

Referring again to FIG. 2, in some examples, the lighting system 200 includes a reflective surface 40 carried by the lighting system body and configured to enhance light from at least one light emitter 220. In the example shown, the reflective surface 40 is disposed between the heat sink 12 and the front housing 10. In some implementations, the lighting system 200 also includes a lens 50 carried by the lighting system body and configured to enhance light from at least one light emitter 220. In the example shown, the lens 50 is disposed on the front housing 10. The lens 50 may be adjustable to defuse and/or focus light from at least one light emitter 220.

Figure 10:
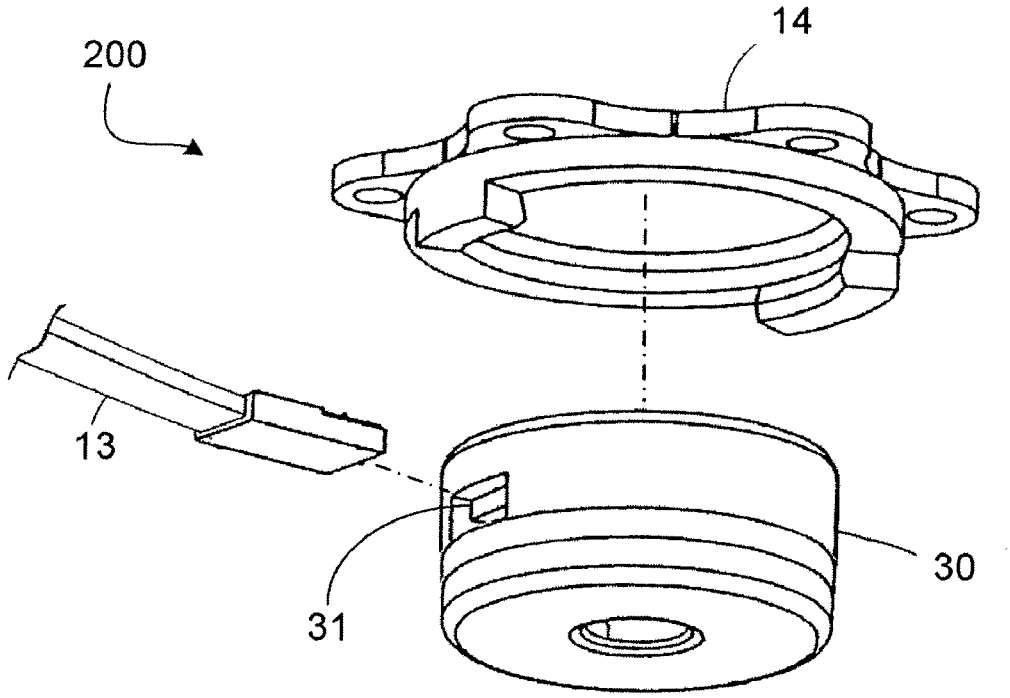
FIGS. 10-12 are perspective views of a lighting system.
Figure 11:
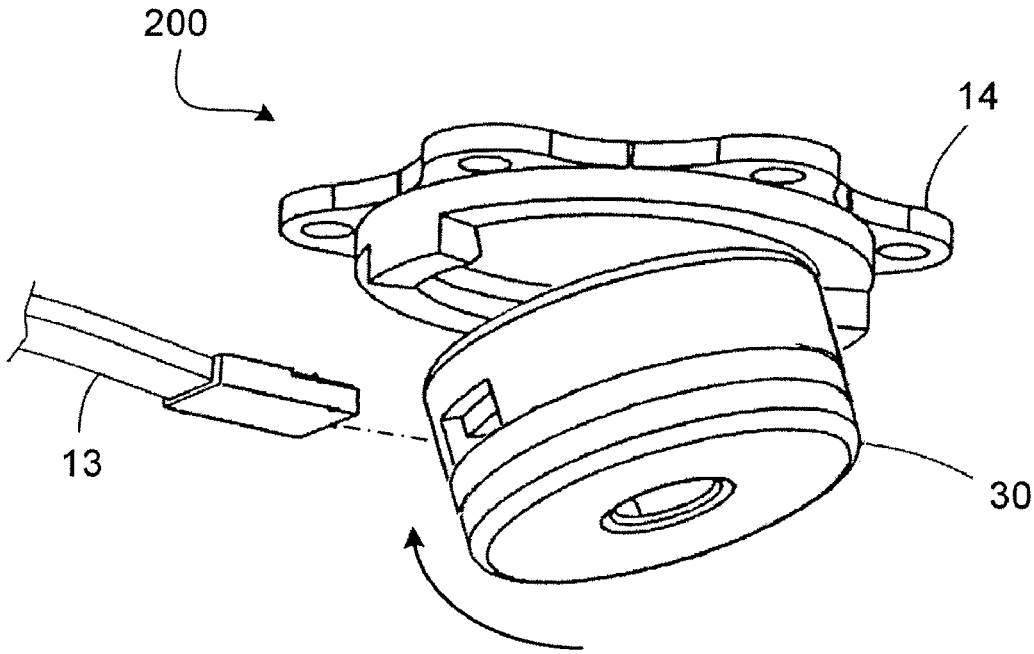
Figure 12:
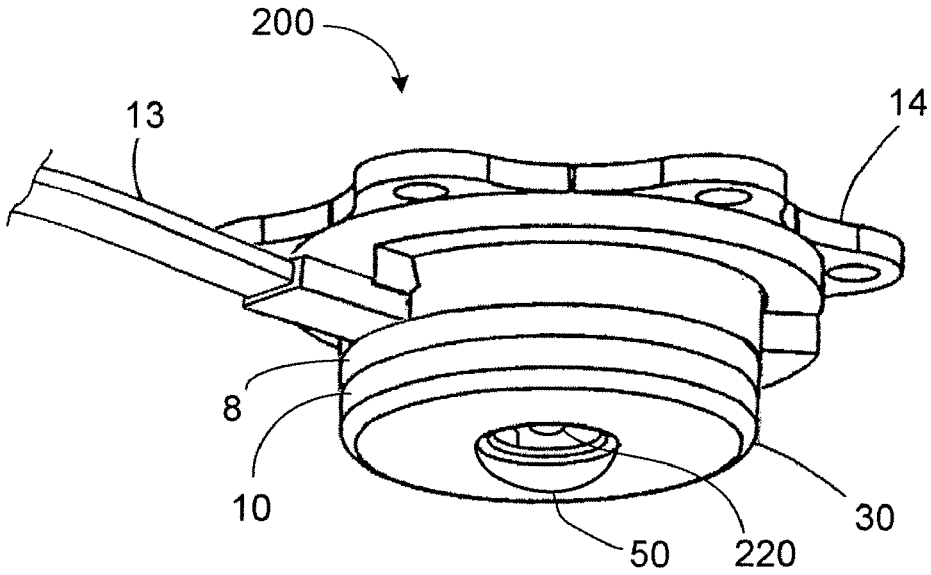

FIGS. 10-12 illustrate an example of servicing the lighting system 200. FIG. 10 shows an example of the lighting system 200 disassembled. The base 14 is fixed to the bag body 100 and the removable main housing 30 can be interchanged with another main housing 30 (e.g. with different light emitters 220). To assemble the lighting system 200, the main housing 30, which carries the light emitter 220 in this example, is inserted into the receptacle 15 (e.g. a socket) of the base 14, as shown in FIG. 11. Then, as shown in FIG. 12, the power connecter 13 is inserted into the main housing 30. In some examples, the main housing 30 is snapped into the socket 15. In other examples, the main housing 30 is secured in the socket 14 by turning. When the portable bag 2 includes multiple lighting cartridges 30 and/or lighting bases 14, different lighting cartridges 30 may be interchanged with different lighting bases 14 in various locations (e.g. to interchange lighting cartridges 30 having different colored light emitters 220). In one example, at least one light emitter is activated by moving the light cartridge relative to the lighting base.

Figure 13:
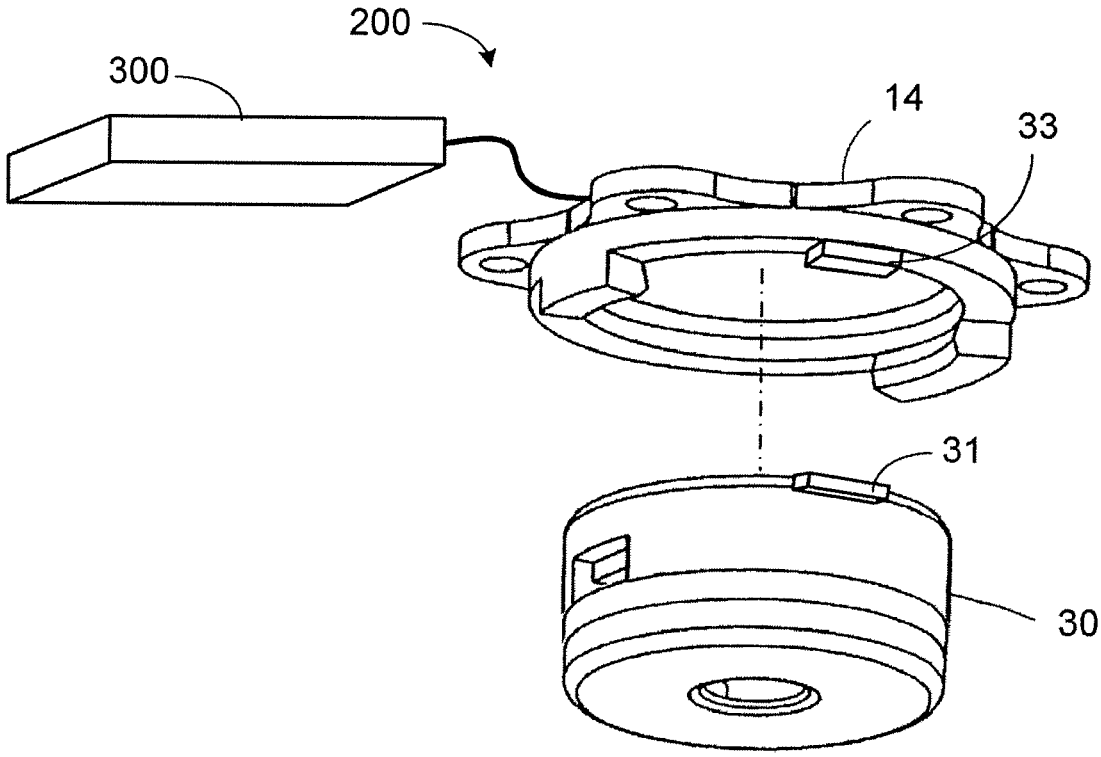
FIGS. 13-14 are exploded views of a lighting system.

Referring to FIGS. 10 and 13, the lighting cartridge 30, in some instances, includes a power connector 31 disposed on an outer surface of the cartridge body 8, 10. The power connector 31 is configured to mate with a corresponding lighting base power connector 33 within a receptacle 15 defined by lighting base 14 as the lighting cartridge 30 is placed within the receptacle to establish an electric power connection to the lighting cartridge 30. In other instances, the lighting cartridge power connector 33 is configured to mate with a corresponding power source power connector 13.

Figure 14:
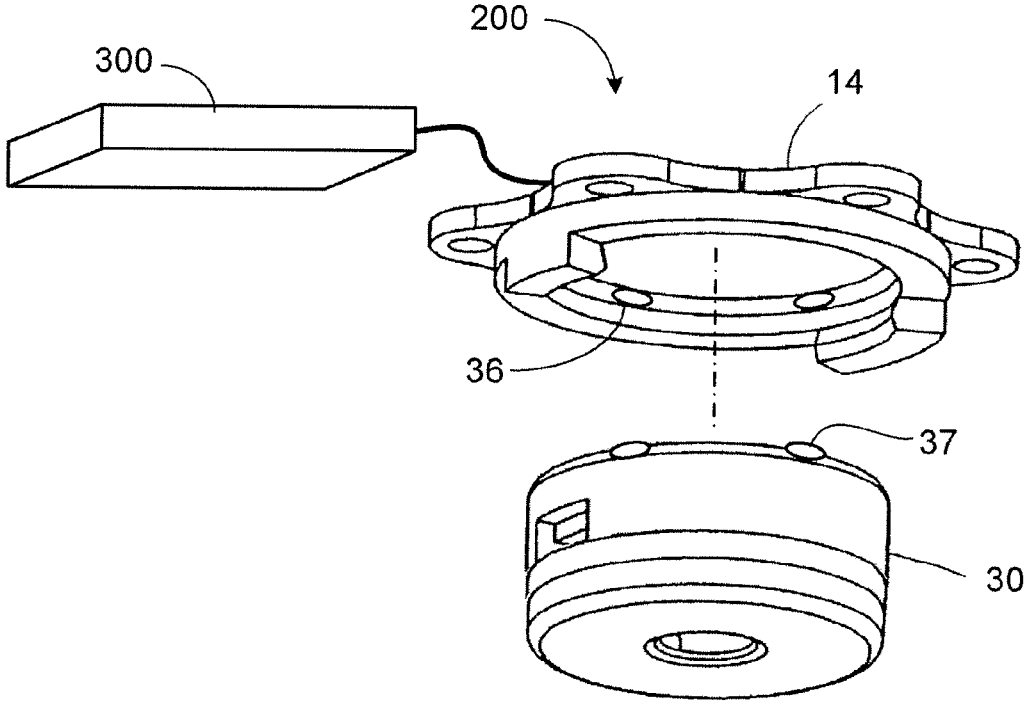

Referring to FIG. 14, in some implementations, the base 14 includes at least one magnet 36 to retain the lighting cartridge 30, which has a magnetically attractable surface configured to mate with the at least one magnet. The magnets 36 may be seeded in the base 14 and in some examples slightly recessed. In some examples, at least one magnet 36 is connected to the power source and delivers power to the lighting cartridge 30. Electrical contacts 37 on the lighting cartridge 30 magnetically mate with corresponding magnets 36 of the base 14 to receive power.

In other implementations, the lighting cartridge 30 is secured to the base 14 by hook and loop fasteners in a similar manner as the example in FIG. 14. In some examples, power is delivered to the lighting cartridge 30 through the hook and loop 15 fasteners. Other engageable fasteners may be used as well.

Figure 15:
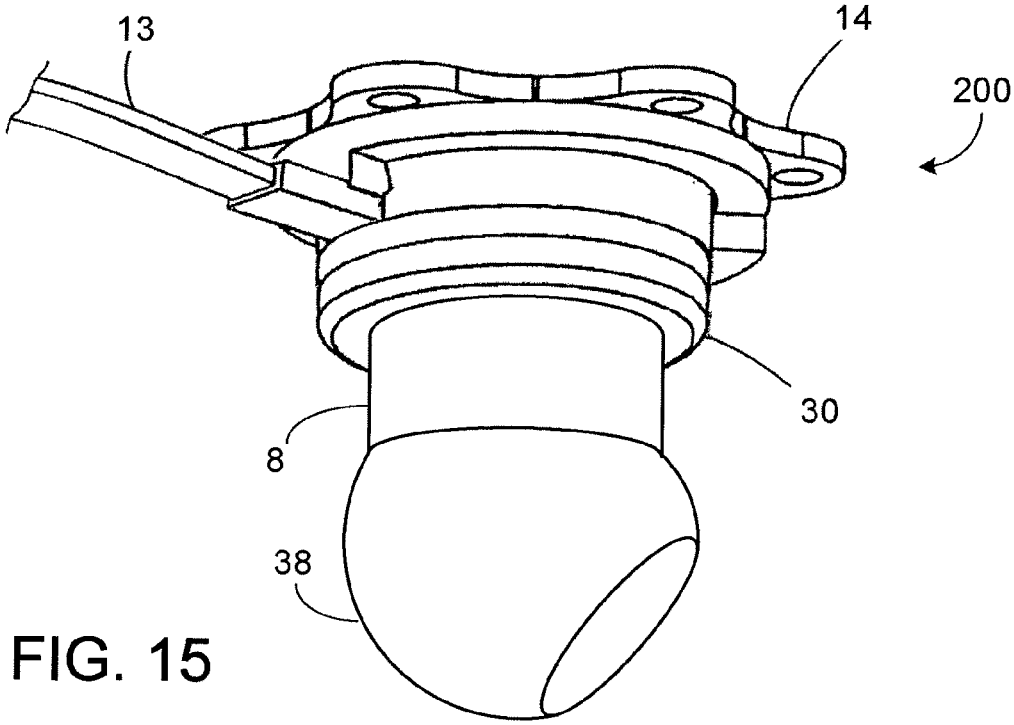
FIG. 15 is a perspective view of a lighting system.

Referring to FIG. 15, the lighting cartridge 30 may be configured to articulate, thereby providing a wide sweepable lighting range. In some implementations, the lighting cartridge 30 includes a cartridge body base 8 and a bezel housing 38 rotatably and telescopically secured to the cartridge body base 8. The bezel housing 38 carries at least one light emitter 220. In some examples, the bezel housing 38 is configured to move along three axes of motion. The bezel housing 38 may also be configured as a switch. In one example, the lightly system 200 is controlled by twisting the bezel housing 38. In another example, the lightly system 200 is controlled by depressing the bezel housing 38 like a button. In some instances, the bezel housing 38 includes a lens 40 configured to focus light emitted by at least one light emitter 220.

Examples of the power supply 300 include a rechargeable battery (e.g. chargeable with a standard A/C plug and/or a 12V power source such as car or RV), at least one solar energy cell, and a hand powered generator.

In some examples, the portable bag 2 includes an audible device 60 carried by the bag body 100. In some instances, the audible device 60 is carried by the main housing 30 or lighting cartridge body 30. The audible device 60 may include a programmable alarm clock, allowing a user to set an alarm or timer. The audible device 60 is programmable with auditory content, in some examples, providing custom audio playback. For example, a user can download and play music, ring tones, alarm tones, etc. In some instances, the audible device 60 is in communication with the control circuit 260 and controllable with the remote controller 260. In other instances, the audible device 60 is in wireless communication with the remote controller 260. Wireless remote activation of the audio device 60 and/or lighting system 200 may be used as a safety procedure, to find/identify the portable bag 2 (e.g. at school or in an airport), and for aesthetics, inter alia. In one example, the audio device 60 and/or lighting system 200 are activated when the remote controller 260 is within a certain range (e.g. 10 feet).

A number of implementations have been described. Nevertheless, it will be understood that various modifications may be made without departing from the spirit and scope of the disclosure. Accordingly, other implementations are within the scope of the following claims.

What is claimed is:

1. A portable bag comprising:

a bag body;

at least one lighting cartridge comprising a cartridge body and at least one light emitter carried by the cartridge body; and at least one lighting base secured to the bag body, the lighting base configured to receive and removably secure the lighting cartridge;

wherein the cartridge body comprises:

a cartridge body base; and a bezel housing rotatably and telescopically secured to the cartridge body base and carrying at least one light emitter.

2. The portable bag of claim 1 wherein the lighting cartridge further comprises a power connector disposed on the cartridge body and configured to mate with a corresponding lighting base power connector within a receptacle defined by lighting base as the lighting cartridge is placed within the receptacle to establish an electric power connection to the lighting cartridge.

3. The portable bag of claim 1 wherein the lighting cartridge further comprises a power connector disposed on the cartridge body and configured to mate with a corresponding power source power connector.

4. The portable bag of claim 1 further comprises a control circuit controlling at least one light emitter.

5. The portable bag of claim 4 further comprising a remote controller in wireless communication with the control circuit to control at least one light emitter.

6. The portable bag of claim 5 wherein the remote controller is at least partially embedded in the bag body.

7. The portable bag of claim 4 wherein the lighting cartridge further comprises an audible device in communication with the control circuit.

8. The portable bag of claim 7 wherein the audible device comprises a programmable alarm clock.

9. The portable bag of claim 1 wherein the bag body comprises a backpack.

10. The portable bag of claim 1 wherein the lighting cartridge further comprises a reflective surface carried by the cartridge body and configured to enhance light from at least one light emitter, and a lens carried by the cartridge body and configured to enhance light from at least one light emitter.

11. The portable bag of claim 1 wherein the base comprises at least one magnet to retain the lighting cartridge, the lighting cartridge having a magnetically attractable surface configured to mate with the at least one magnet.

12. The portable bag of claim 11 wherein at least one magnet delivers power to the lighting cartridge.

13. The portable bag of claim 1 wherein the lighting cartridge is secured to the base by hook and loop fasteners.

14. The portable bag of claim 13 wherein power is delivered to the lighting cartridge through the hook and loop fasteners.

15. The portable bag of claim 1 wherein the bezel housing is configured as a switch.

16. The portable bag of claim 1 wherein at least one light emitter is activated by moving the light cartridge relative to the lighting base.

17. The portable bag of claim 1 wherein the bag body comprises a main compartment and at least one strap secured to the main compartment.

18. The portable bag of claim 17 further comprising a switch secured to the at least one strap and in communication with the lighting cartridge.

* * * * *